US009799156B2

(12) United States Patent
Stanley et al.

(10) Patent No.: US 9,799,156 B2
(45) Date of Patent: Oct. 24, 2017

(54) CONTROLLING TRAFFIC WITHOUT INTEGRATING WITH A SECURITY VENDOR

(71) Applicant: OTIS ELEVATOR COMPANY, Farmington, CT (US)

(72) Inventors: Jannah A. Stanley, Portland, CT (US); Ashley Chapman, Plainville, CT (US); Matthew Joyce, Avon, CT (US)

(73) Assignee: OTIS ELEVATOR COMPANY, Farmington, CT (US)

( * ) Notice: Subject to any disclaimer, the term of this patent is extended or adjusted under 35 U.S.C. 154(b) by 0 days.

(21) Appl. No.: 14/784,613

(22) PCT Filed: Apr. 16, 2013

(86) PCT No.: PCT/US2013/036744

§ 371 (c)(1),
(2) Date: Oct. 15, 2015

(87) PCT Pub. No.: WO2014/171924

PCT Pub. Date: Oct. 23, 2014

(65) Prior Publication Data

US 2016/0267731 A1 Sep. 15, 2016

Related U.S. Application Data

(62) Division of application No. 13/467,599, filed on May 9, 2012.

(51) Int. Cl.

| | |
|---|---|
| ***G07C 9/00*** | (2006.01) |
| ***B01L 3/00*** | (2006.01) |
| *B01L 3/02* | (2006.01) |

(52) U.S. Cl.
CPC ..... *G07C 9/00134* (2013.01); *B01L 3/0293* (2013.01); *B01L 3/50273* (2013.01);
(Continued)

(58) Field of Classification Search
CPC ..... G07C 9/00126
See application file for complete search history.

(56) References Cited

U.S. PATENT DOCUMENTS 5,159,163 A * 10/1992 Bahjat ..... B66B 1/20 187/381
5,200,583 A 4/1993 Kupersmith et al.
(Continued)

FOREIGN PATENT DOCUMENTS

CN 1415527 A 5/2003
KR 1020080010351 A 1/2008

OTHER PUBLICATIONS

International Search Report for application PCT/US2013/036744, dated Jan. 22, 2014, 6 pages.
(Continued)

*Primary Examiner* — Curtis Odom
(74) *Attorney, Agent, or Firm* — Cantor Colburn LLP

(57) ABSTRACT

Embodiments are directed to providing access without determining an identity of a requester. A fixture may receive a rule pertaining to access to a floor of a building. The fixture may receive a request to access the floor of the building. The fixture may grant access to the floor based on a determination that the rule indicates that access to the floor should be granted.

12 Claims, 3 Drawing Sheets

(52) U.S. Cl.
CPC ..... *B01L 3/563* (2013.01); *G07C 9/00166* (2013.01); *B01L 3/0255* (2013.01); *B01L 3/0262* (2013.01); *B01L 2200/16* (2013.01); *B01L 2300/047* (2013.01); *B01L 2300/0672* (2013.01); *B01L 2300/0816* (2013.01); *B01L 2400/024* (2013.01); *B01L 2400/0406* (2013.01); *B01L 2400/0481* (2013.01); *B01L 2400/0683* (2013.01); *G07C 2209/08* (2013.01)

(56) References Cited

U.S. PATENT DOCUMENTS

| | | | | |
|---|---|---|---|---|
| 7,093,693 | B1 | 8/2006 | Gazdzinski | |
| 2003/0098776 | A1 | 5/2003 | Friedli | |
| 2003/0131235 | A1* | 7/2003 | Wheeler | G06F 21/32 713/168 |
| 2005/0099288 | A1 | 5/2005 | Spitz et al. | |
| 2012/0305340 | A1 | 12/2012 | Wu | |

OTHER PUBLICATIONS

JB Learning, "Chapter 2 Access Control Methodologies", Oct. 12, 2004, 30 pages.
That's My View, "Location Based Printing in View 4.5", http://www.thatsmyview.net/2010/09/14/location-based-printing-in-view-4-5/, Sep. 14, 2010, 7 pages.
Written Opinion for application PCT/US2013/036744, dated Jan. 22, 2014, 6 pages.
Chinese Office Action and Search Report for application CN 201380077516.X, dated Nov. 28, 2016, 6pgs.

* cited by examiner

CONTROLLING TRAFFIC WITHOUT INTEGRATING WITH A SECURITY VENDOR

BACKGROUND

Currently, traffic (e.g., foot traffic) in a building, such as an office building, may be regulated on the basis of user credentials. For example, a person may carry a card or the like that can be swiped or presented to an access terminal. In some instances, the card may serve a dual-purpose, such as an employee identification badge. The person may be provided access to a resource (e.g., an elevator car, a floor of the building, entrance to a space (e.g., an office) within the building, etc.) if the person is authorized to access the resource.

Integration of credentials with a security vendor is often necessary in order to control traffic. When integrating with a security vendor, options may be limited, as an owner or tenant of a building may generally need to adhere to the security platform that is provided by the security vendor. Alternatively, the owner/tenant may have to pay the security vendor an additional fee to design or implement customized security features. As such, providing conditional access with respect to a secured resource can be cumbersome, inflexible, and expensive.

BRIEF SUMMARY

An embodiment of the disclosure is directed to a method for providing access without determining an identity of a requester, comprising: receiving, by a fixture, a rule pertaining to access to a floor of a building, receiving, by the fixture, a request to access the floor of the building, and granting, by the fixture, access to the floor based on a determination that the rule indicates that access to the floor should be granted.

An embodiment of the disclosure is directed to an apparatus comprising: at least one processor, and memory having instructions stored thereon that, when executed by the at least one processor, cause the apparatus to: receive a rule pertaining to access to a floor of a building, receive a request to access the floor of the building, and grant access to the floor based on a determination that the rule indicates that access to the floor should be granted without determining an identity of a requester.

An embodiment of the disclosure is directed to a system comprising: a fixture configured to receive a rule pertaining to access to a resource of a building and receive a request to access the resource, the fixture is configured to determine when access to the resource should be granted without determining an identity of a requester, and a conveyance device configured to provide access to the resource when the fixture determines that the request to access the resource should be granted.

Additional embodiments are described below.

BRIEF DESCRIPTION OF THE DRAWINGS

The present disclosure is illustrated by way of example and not limited in the accompanying figures in which like reference numerals indicate similar elements.

DETAILED DESCRIPTION

Figure 1:
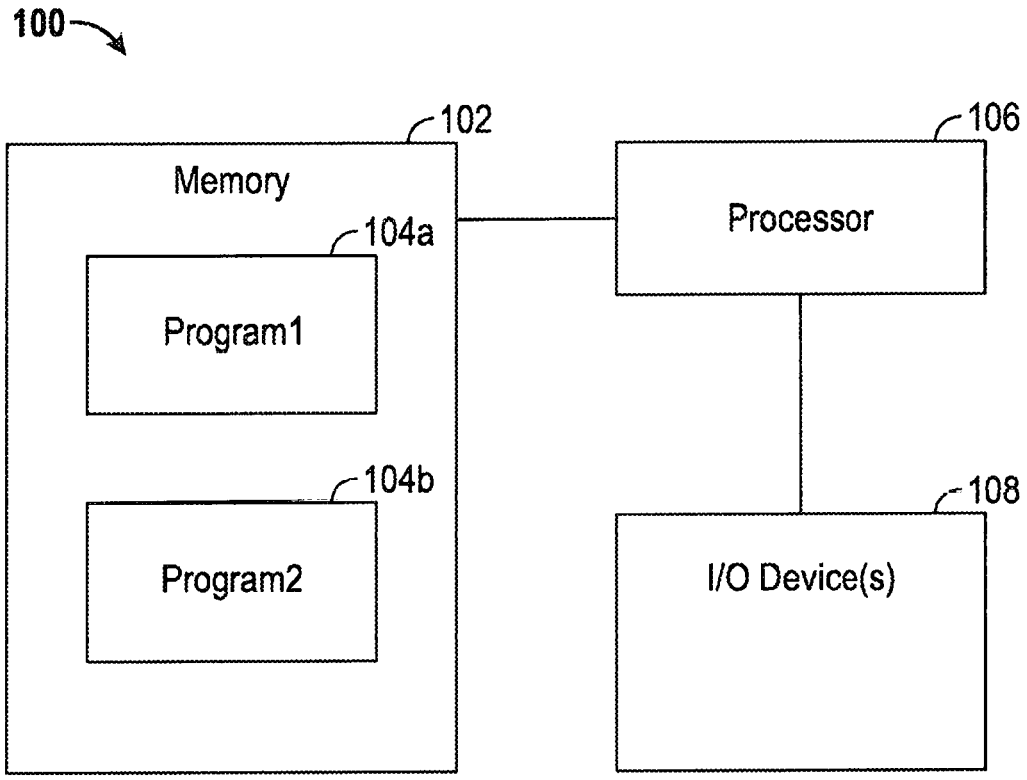
FIG. 1 is a schematic block diagram illustrating an exemplary computing system in accordance with one or more aspects of this disclosure.

It is noted that various connections are set forth between elements in the following description and in the drawings (the contents of which are included in this disclosure by way of reference). It is noted that these connections in general and, unless specified otherwise, may be direct or indirect and that this specification is not intended to be limiting in this respect. In this respect, a coupling between entities may refer to either a direct or an indirect connection.

Exemplary embodiments of apparatuses, systems, and methods are described for providing conditional access to a secure resource. In some embodiments, access to a resource may be determined based on the use and/or location of one or more fixtures. In some embodiments, one or more rules may be used to determine whether to grant access to a resource. The rules may be established by, e.g., a building owner or tenant. In some embodiments, the rules may be a function of one or more parameters or conditions, such as a day of week or time of day. In some embodiments, the rules may be input directly to the fixture or may be implemented using one or more other devices. For example, in some embodiments, the rules may be input to a computer remotely located from a fixture.

Referring to FIG. 1, an exemplary computing system 100 is shown. The system 100 is shown as including a memory 102. The memory 102 may store executable instructions. The executable instructions may be stored or organized in any manner and at any level of abstraction, such as in connection with one or more processes, routines, procedures, methods, etc. As an example, at least a portion of the instructions are shown in FIG. 1 as being associated with a first program 104*a* and a second program 104*b*.

The instructions stored in the memory 102 may be executed by one or more processors, such as a processor 106. The processor 106 may be coupled to one or more input/output (I/O) devices 108. In some embodiments, the I/O device(s) 108 may include one or more of a keyboard or keypad, a touchscreen or touch panel, a display screen, a microphone, a speaker, a mouse, a button, a remote control, a joystick, a printer, a telephone or mobile device (e.g., a smartphone), etc. The I/O device(s) 108 may be configured to provide an interface to allow a user to interact with the system 100.

The system 100 is illustrative. In some embodiments, one or more of the entities may be optional. In some embodiments, additional entities not shown may be included. For example, in some embodiments the system 100 may be associated with one or more networks, such as one or more computer or telephone networks. In some embodiments, the entities may be arranged or organized in a manner different from what is shown in FIG. 1.

Figure 2:
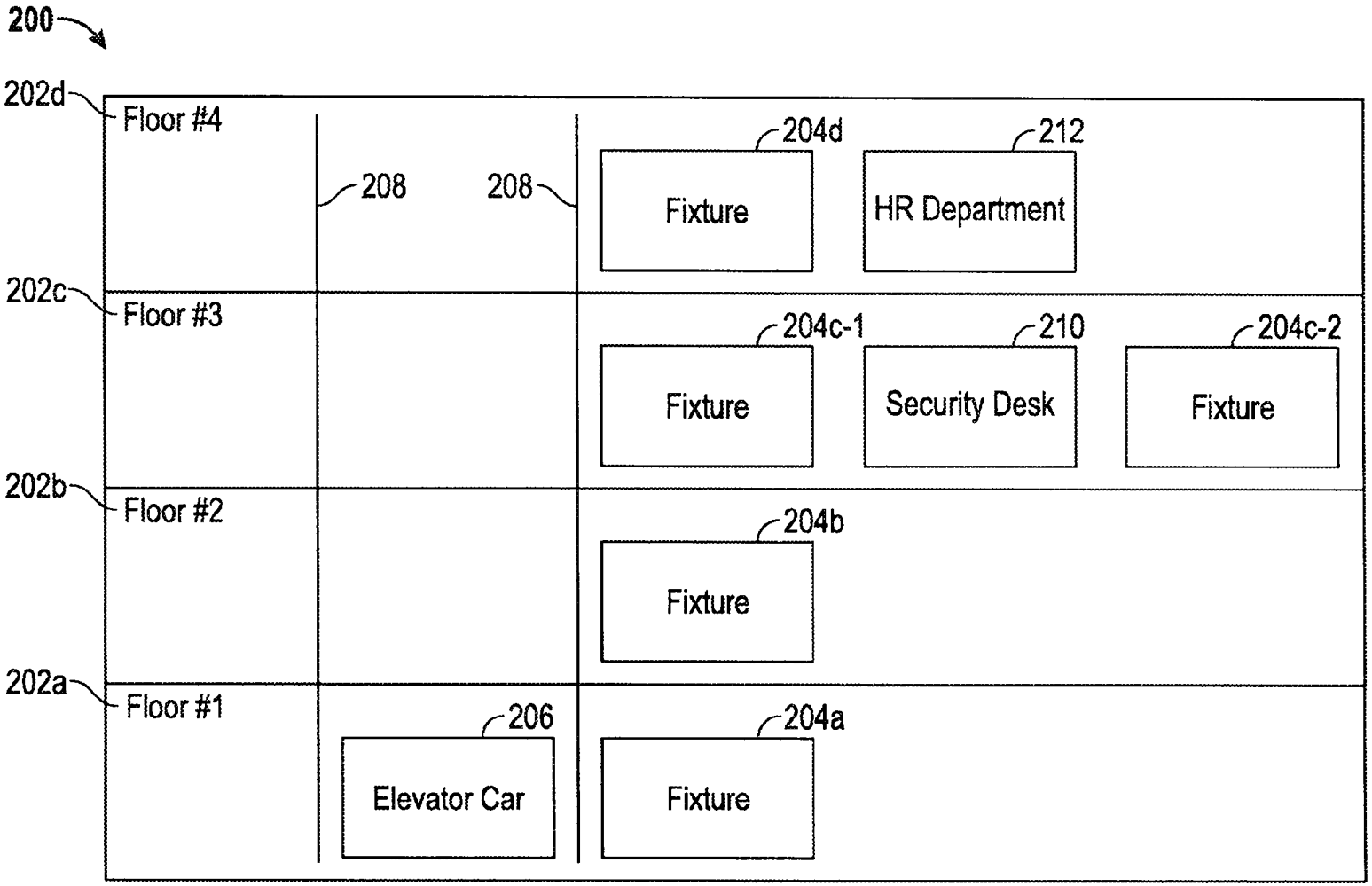
FIG. 2 illustrates an exemplary block diagram of a building in accordance with one or more embodiments.

Turning now to FIG. 2, an exemplary block diagram of a building 200 in accordance with one or more embodiments is shown. The building 200 is shown as including four floors, denoted as floors 202*a* through 202*d*. In some embodiments, a building may include more or less than four floors.

The building 200 is shown as including one or more fixtures; specifically, fixtures 204*a*, 204*b*, 204*c*-1, 204*c*-2, and 204*d*. The fixtures 204*a*, 204*b*, 204*c*-1, 204*c*-2, and 204*d* may be located on the floors shown in FIG. 2. Thus, the fixture 204*a* may be located on the floor 202*a*, the fixture 204*b* may be located on the floor 202*b*, the fixtures 204*c*-1 and 204*c*-2 may be located on the floor 202*c*, and the fixture 204*d* may be located on the floor 202*d*.

In some embodiments, one or more of the fixtures 204*a*, 204*b*, 204*c*-1, 204*c*-2, and 204*d* may correspond to, or include, one or more I/O devices, such as the I/O device(s) 108 of FIG. 1. In this respect, a fixture may provide an interface for a user to interact with. For example, the fixtures 204*a*, 204*b*, 204*c*-1, 204*c*-2, and 204*d* may be used to obtain access to a secured resource.

For purposes of ease of explanation and illustration, it may be assumed that the secured resource corresponds to conditional access being provided to the floor 202*d*. The floors 202*c* and 202*d* may be leased by a first tenant, and the floor 202*b* may be leased by a second tenant. The floor 202*a* may correspond to a "public floor" of the building 200. As used herein, a public floor corresponds to a floor that is not owned or controlled by any particular tenant. A lobby floor is one example of a floor that could be considered public. Other types of public floors or spaces may include a parking garage, a cafeteria, etc.

An elevator system may be used to travel between the floors 202*a* through 202*d* of the building 200. For example, an elevator car 206 may traverse a hoistway 208 in order to convey passengers or materials to one or more of the floors 202*a* through 202*d*. The fixtures 204*a*, 204*b*, 204*c*-1, and 204*d* may be located just outside of the hoistway 208. The fixture 204*c*-2 may be located behind a security desk 210 located on the floor 202*c*.

When a user enters the building 200 via the floor 202*a* (e.g., a lobby floor), the user may approach the hoistway 208 in order to call or command the elevator car 206 to the floor 202*a*. The user may be a visitor of the building 200 (e.g., the user may be a prospective or candidate employee of the first tenant and may come to the building 200 for purposes of a job interview with the first tenant) and may call the elevator car 206 to the floor 202*a* in order to go to the floor 202*d* where the human resources (HR) department 212 of the first tenant may be located.

In some instances the user might not be given direct access to the floor 202*d* from the floor 202*a* via the elevator car 206. For example, if the user enters a request on the fixture 204*a* to go to the floor 202*d*, the request may be declined, or the user may be instructed that the user can only, or will instead, be taken to the floor 202*c* from the floor 202*a*.

Assuming that the user travels in the elevator car 206 from the floor 202*a* to the floor 202*c*, the user may get out of the elevator car 206 at the floor 202*c*. The user may then enter the request to go to the floor 202*d* at the fixture 204*c*-1. Assuming that the first tenant has provided a security policy or rule that would allow for such a request to be accepted, the user may re-enter the elevator car 206 (or enter another elevator car if more than one elevator car or hoistway is available) and travel from the floor 202*c* to the floor 202*d*. The first tenant may locate one or more recording devices (e.g., a camera) just outside the hoistway 208 on the floor 202*c* in order to obtain a recording of traffic with respect to the first tenant. For example, the recording device may record or capture the presence and appearance of the user.

In some embodiments, a security policy or rule established by, e.g., the first tenant may be more rigid than the scenario described above. For example, when the user gets out of the elevator car 206 at floor 202*c*, the user may need to approach the security desk 210 and explain to a security officer or security personnel located behind the security desk 210 the purpose of the user's visit to the building 200 or the purpose of the user's visit with respect to the first tenant (e.g., the user having a job interview with the first tenant). If the security officer/personnel is satisfied with the user's response (e.g., the security officer/personnel confirms that the user's explanation for the visit is proper), the security officer/personnel may grant the user access to the floor 202*d* by entering a command on the fixture 204*c*-2. The granting of the access to the floor 202*d* by the security officer/personnel may be conditioned on the security officer/personnel presenting a key or credential to the fixture 204*c*-2. Once authorized by the security officer/personnel, the user may re-enter the elevator car 206 (or enter another elevator car if more than one elevator car or hoistway is available) and travel from the floor 202*c* to the floor 202*d*.

In either scenario described above, the user obtained access to the floor 202*d* from the floor 202*a* by way of the floor 202*c* (e.g., by virtue of a command/request having been entered on the fixture 204*c*-1 or the fixture 204*c*-2). In this manner, access to the floor 202*d* from the floor 202*a* may be conditioned on a user first going through floor 202*c*. Relative to conventional techniques where access to a secure resource may be obtained through use of credentials specifically tied to a user, aspects of the disclosure may tie access rights or capabilities to the resource through a fixture.

Different security rules or policies may be applied with respect to a resource. For example, if the user completes a job interview in the HR department 212 on the floor 202*d*, the user might be given unrestricted, direct access from the floor 202*d* to the floor 202*a*, such that the user may exit the building 200. In other words, the user might not have to travel back to the floor 202*c* in order to leave the building 200. Various criteria may be used to establish one or more rules regarding access to a secure resource. For example, a security policy may consider factors such as a day of week, a time of day, a direction of travel, an identification of an originating floor, an identification of a destination floor, etc.

Rules governing access rights to a secure resource may be established in one or more ways. For example, a default rule may initially be provided. The owner of a building or a tenant may establish one or more rules, potentially overwriting a default rule in the process.

A rule may be entered or modified on one or more machines or devices. For example, a rule may be entered or modified on a fixture (e.g., the fixture 204*c*-2). In some embodiments, a rule may be entered or modified on a computing device (e.g., a mobile device), and the rule may be communicated from the computing device to the fixture via one or more networks. A key or credential may need to be presented to the computing device or the fixture to allow for entry or modification of a rule.

Figure 3:
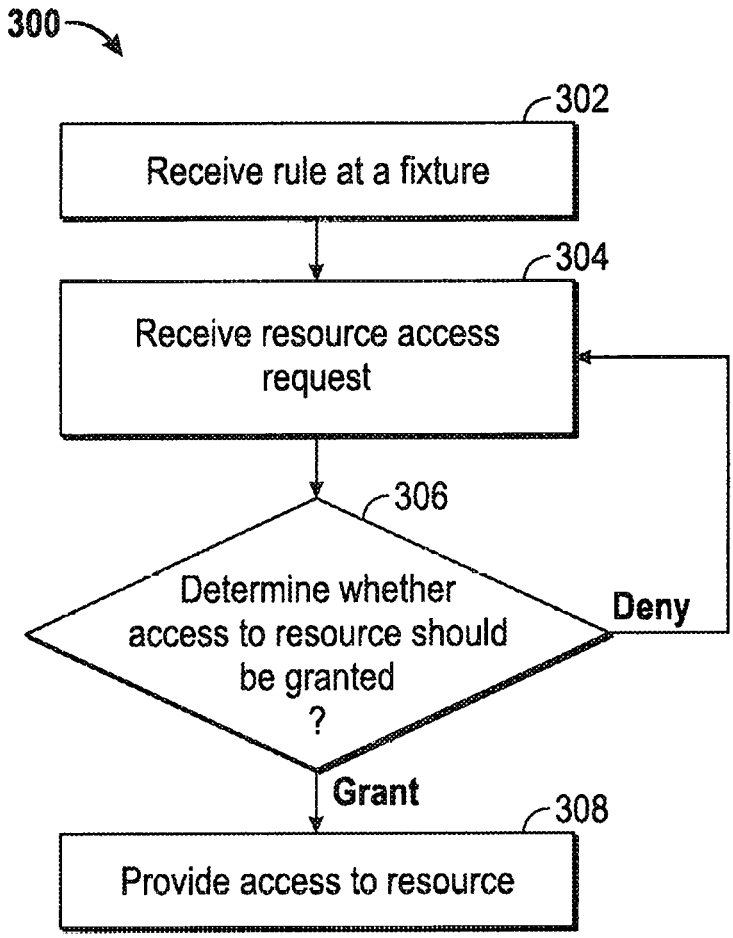
FIG. 3 illustrates a flow chart of an exemplary method in accordance with one or more embodiments of the disclosure.

FIG. 3 illustrates a method 300 that may be used in connection with one or more entities, devices or systems, such as those described herein. For example, the method 300 may be used by a fixture to provide conditional access to a secure resource.

In block 302, one or more rules may be received by a fixture. For example, a rule may be input at the fixture. A rule may be received by the fixture, potentially over one or more networks. Receipt of a rule by the fixture in block 302 may pertain to an initial rule or a modification of an existing rule.

In block 304, an access request may be received at the fixture. The access request may pertain to a resource, such as floor of a building.

In block 306, the fixture (or another device or entity) may determine whether the request for access to the resource of block 304 should be granted. The determination may be based one or more of the rules of block 302.

If, based on the rule(s) of block 302, it is determined in block 306 that access should not be granted (e.g., the "deny" path is taken out of block 306), then flow may proceed from block 306 to block 304 to receive another access request. As part of the flow from block 306 to block 304, an indication may be provided that the access request was denied. In some embodiments, the indication may also specify a reason why the access request was denied. Specification of a reason may assist a user in determining whether the user improperly entered an access request in block 304.

If, based on the rule(s) of block 302, it is determined in block 306 that access should be granted (e.g., the "grant" path is taken out of block 306), then flow may proceed from block 306 to block 308 in order to provide access to the resource. The providing of the access to the resource may be unrestricted, such that the user may have immediate or direct access to the resource. Alternatively, the user may merely be provided indirect access to the resource. For example, if the (ultimate) resource pertains to a floor of a building, as part of block 308 the user may have to visit another floor of the building to actually obtain access to a floor of interest.

The method 300 is illustrative. In some embodiments, one or more of the blocks or operations (or portions thereof) may be optional. In some embodiments, additional operations not shown may be included. In some embodiments, the operations may execute in an order or sequence different from what is shown.

While some of the examples described herein related to elevator systems, aspects of this disclosure may be applied in connection with other types of conveyance devices, such as a dumbwaiter, an escalator, a moving sidewalk, a wheelchair lift, etc.

Embodiments of the disclosure may be used to control or monitor traffic flow in a building. Passengers of an elevator may be limited to destinations within landings occupied by a specific tenant. If the tenant has a security desk on one of its landings, only that landing might be accessible from a public floor (e.g., a lobby), thereby allowing the tenant to verify that the passenger is allowed to access the tenant's (other) floors.

Embodiments of the disclosure may be tied to one or more particular machines. For example, access rights with respect to a resource may be tied to a fixture. Such a relationship lies in stark contrast to traditional approaches of tying access rights to credentials associated with an identified user.

As described herein, in some embodiments various functions or acts may take place at a given location and/or in connection with the operation of one or more apparatuses, systems, or devices. For example, in some embodiments, a portion of a given function or act may be performed at a first device or location, and the remainder of the function or act may be performed at one or more additional devices or locations.

Embodiments may be implemented using one or more technologies. In some embodiments, an apparatus or system may include one or more processors, and memory storing instructions that, when executed by the one or more processors, cause the apparatus or system to perform one or more methodological acts as described herein. Various mechanical components known to those of skill in the art may be used in some embodiments.

Embodiments may be implemented as one or more apparatuses, systems, and/or methods. In some embodiments, instructions may be stored on one or more computer program products or computer-readable media, such as a transitory and/or non-transitory computer-readable medium. The instructions, when executed, may cause an entity (e.g., an apparatus or system) to perform one or more methodological acts as described herein.

Aspects of the disclosure have been described in terms of illustrative embodiments thereof. Numerous other embodiments, modifications and variations within the scope and spirit of the appended claims will occur to persons of ordinary skill in the art from a review of this disclosure. For example, one of ordinary skill in the art will appreciate that the steps described in conjunction with the illustrative figures may be performed in other than the recited order, and that one or more steps illustrated may be optional.

What is claimed is:

1. An apparatus comprising:

at least one processor; and memory having instructions stored thereon that, when executed by the at least one processor, cause the apparatus to:

receive a rule pertaining to access to a floor of a building, receive a request to access the floor of the building, and grant access to the floor based on a determination that the rule indicates that access to the floor should be granted without determining an identity of a requester;

wherein the rule is based on an identification of an originating floor and an identification of a destination floor.

2. The apparatus of claim 1, wherein the rule comprises at least one of: an initial rule and a modification to an existing rule.

3. The apparatus of claim 1, wherein the rule is further based on at least one of: a day of week, a time of day and a direction of travel for an elevator.

4. An apparatus comprising:

at least one processor; and memory having instructions stored thereon that, when executed by the at least one processor, cause the apparatus to:

receive a rule pertaining to access to a floor of a building, receive a request to access the floor of the building, and grant access to the floor based on a determination that the rule indicates that access to the floor should be granted without determining an identity of a requester;

wherein the rule specifies that a user must go to a second floor via an elevator prior to going to the floor.

5. A system comprising:

a fixture configured to receive a rule pertaining to access to a resource of a building and receive a request to access the resource;

the fixture is configured to determine when access to the resource should be granted without determining an identity of a requester; and a conveyance device configured to provide access to the resource when the fixture determines that the request to access the resource should be granted;

wherein access to the resource is based on an identification of an originating location and an identification of a destination location.

6. The system of claim 5, wherein the conveyance device comprises at least one of: an elevator, a dumbwaiter, an escalator, a moving sidewalk, and a wheelchair lift.

7. The system of claim 5, wherein the fixture is configured to provide an indication that access to the resource is denied when the fixture determines that the request to access the resource should be denied.

8. The system of claim 7, wherein the indication specifies a reason why access to the resource is denied.

9. A system comprising:

a fixture configured to receive a rule pertaining to access to a resource of a building and receive a request to access the resource;

the fixture is configured to determine when access to the resource should be granted without determining an identity of a requester; and a conveyance device configured to provide access to the resource when the fixture determines that the request to access the resource should be granted;

wherein the rule indicates that a user must access a second resource prior to accessing the resource, and wherein the fixture is configured to provide an indication that the user must access the second resource.

10. The system of claim 9, further comprising:

a second fixture associated with the second resource, wherein the second fixture is configured to receive a request to access the resource and grant access to the resource based on the request to access the resource received by the second fixture.

11. The system of claim 9, wherein the resource comprises a floor of the building, and wherein the second resource comprises a second floor of the building.

12. The system of claim 9, wherein the floor and the second floor are affiliated with at least one of: an owner of the building and a tenant of the building.

* * * * *